US007105992B2

(12) United States Patent
Derraa

(10) Patent No.: US 7,105,992 B2
(45) Date of Patent: Sep. 12, 2006

(54) FIELD EMISSION DEVICE HAVING INSULATED COLUMN LINES AND METHOD OF MANUFACTURE

(75) Inventor: Ammar Derraa, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/666,236

(22) Filed: Sep. 19, 2003

(65) Prior Publication Data

US 2004/0061430 A1 Apr. 1, 2004

Related U.S. Application Data

(62) Division of application No. 09/383,331, filed on Aug. 26, 1999, now Pat. No. 7,052,350.

(51) Int. Cl.
*H01J 1/304* (2006.01)
*H01J 19/24* (2006.01)

(52) U.S. Cl. ..... 313/309; 313/336; 313/496

(58) Field of Classification Search ..... 313/309, 313/336, 351, 496
See application file for complete search history.

(56) References Cited

U.S. PATENT DOCUMENTS

| | | | | |
|---|---|---|---|---|
| 4,517,226 | A | 5/1985 | Baldi et al. | 437/245 |
| 4,525,733 | A | 6/1985 | Losee | 257/773 |
| 4,556,897 | A | 12/1985 | Yorikane et al. | 257/763 |
| 4,561,009 | A | 12/1985 | Yonezawa et al. | 257/763 |
| 4,786,962 | A | 11/1988 | Koch | 257/751 |
| 4,855,636 | A * | 8/1989 | Busta et al. | 313/336 |
| 4,857,161 | A | 8/1989 | Borel et al. | 204/192.26 |
| 4,899,206 | A | 2/1990 | Sakurai et al. | 257/734 |
| 4,940,916 | A | 7/1990 | Borel et al. | 313/306 |
| 4,942,138 | A | 7/1990 | Miki | 437/182 |
| 5,106,781 | A | 4/1992 | Penning De Vries | 437/192 |
| 5,162,704 | A | 11/1992 | Kobori et al. | |
| 5,313,100 | A | 5/1994 | Ishii et al. | 257/751 |
| 5,393,565 | A | 2/1995 | Suzuki et al. | 427/255.2 |
| 5,399,236 | A | 3/1995 | Ha et al. | 156/643 |
| 5,406,121 | A | 4/1995 | Toyoda | 257/740 |

(Continued)

OTHER PUBLICATIONS

Mitsiri Tanaka, et al., A New Living Method of Full Color FED Panel, R&D Center FUTABA Corporation, 1080 Yabuzuka, Chosei, Chiba 299-43, Japan, IDW (1996) pp. 151-154.

*Primary Examiner*—Karabi Guharay
(74) *Attorney, Agent, or Firm*—TraskBritt, PC

(57) ABSTRACT

An FED and a method of manufacture are provided. The FED includes a cathode assembly containing an improved column line structure. The column line structure includes a conductive structure formed on a substrate. A resistive layer is formed on the conductive structure, and an insulator layer is formed partly over the resistive layer. The contact between the base of the emitter tips and the addressing column line is achieved through a lateral side that is not covered by the insulator layer. The insulator layer helps reduce the possibility of electrical shorting between the addressing column line and the row line structure of the cathode assembly. The insulator layer on top of the addressing column line will allow the use of a thinner subsequent dielectric layer. This thinner dielectric layer, which supports the grid, will provide a lower RC time constant and help achieve better video rate operation. The thinner dielectric layer also will result in smaller grid openings above the tips. This will provide for better beam spots, and, therefore, better image resolution. The thinner dielectric layer will require less applied voltage to extract electrons from the tips, resulting in lower power consumption for the FED.

20 Claims, 3 Drawing Sheets

U.S. PATENT DOCUMENTS 5,449,640 A 9/1995 Hunt et al. ..... 438/640
5,470,792 A 11/1995 Yamada ..... 437/195
5,521,461 A * 5/1996 Garcia ..... 313/336
5,534,743 A 7/1996 Jones et al. ..... 313/309
5,578,896 A 11/1996 Huang ..... 313/309
5,587,339 A 12/1996 Wyborn et al. ..... 437/195
5,589,728 A * 12/1996 Levine et al. ..... 313/336
5,594,297 A 1/1997 Shen et al. ..... 313/309
5,594,298 A 1/1997 Itoh et al. ..... 313/336
5,641,703 A 6/1997 Cohen et al. ..... 438/467
5,751,272 A 5/1998 Silverbrook et al. ..... 345/149
5,772,485 A 6/1998 Jeng et al.
5,894,188 A * 4/1999 Chakvorty et al. ..... 313/309
6,015,323 A 1/2000 Moradi et al.
6,069,443 A 5/2000 Jones et al. ..... 313/504
6,136,621 A 10/2000 Jones et al.
6,211,608 B1 4/2001 Raina et al. ..... 313/309

* cited by examiner

FIELD EMISSION DEVICE HAVING INSULATED COLUMN LINES AND METHOD OF MANUFACTURE

CROSS-REFERENCE TO RELATED APPLICATION

This application is a divisional of application Ser. No. 09/383,331, filed Aug. 26, 1999, now patented U.S. Pat. No. 7,052,350.

FIELD OF THE INVENTION

The present invention relates generally to flat panel displays and, more particularly, to field emission devices ("FEDs") and methods for manufacturing the same.

BACKGROUND OF THE INVENTION

As is well known, FED technology operates on the principle of cathodoluminescent phosphors being excited by cold cathode field emission electrons. FIG. 1 is a simplified illustration of a representative portion of a prior art FED 10. In general, the FED 10 comprises a cathode assembly 6 and an anode assembly 8 separated from each other by spacers 4.

The cathode assembly 6 is typically manufactured using conventional photolithographic processes to form successively defined features on a substrate or base plate 12. In general, a conductive emitter electrode structure 14 is first formed on the substrate 12. Next, a resistive layer 15 is deposited over the conductive structure 14. A pattern of spaced-apart conical cold cathode emitter tips or micropoints 18 is then formed on the substrate 12, followed by a dielectric structure 20 and a conductive or extraction grid structure 22.

The substrate or base plate 12 is typically formed of glass. The conductive structure 14 may be formed of a metal. The micropoints 18 may be constructed of a number of materials such as, e.g., silicon or molybdenum.

The conductive structure 14 with the covering resistive layer 15 encircles themicropoints 18 of a pixel group (described below). The portions of the conductive structure 14 shown in FIG. 1 are thus electrically connected and form a column line, which is part of an addressable matrix as will be described below.

The resistive layer 15 comprising, e.g., amorphous silicon, covers the top and sides of the conductive structure 14. As shown, the outer sides of the base of each conical micropoint 18 are in contact with the resistive layer covering the conductive structure 14. The resistive layer 15 separates the conductive structure 14 from the micropoints 18 and helps prevent damage to the tips of the micropoints 18.

After the micropoints 18 have been formed on the base plate 12, a dielectric layer is deposited over the micropoints 18 and the resistive layer 15. The dielectric layer, which is later formed into the dielectric structure 20, may comprise silicon dioxide or other materials. Next, a conductive layer is deposited over the dielectric layer. This conductive layer, which is later formed into the conductive grid structure 22, may be made from a variety of materials including chromium, molybdenum and doped polysilicon. Then, using a photolithography/etch process, the dielectric layer and the conductive layer are etched to form the dielectric and conductive grid structures 20, 22, respectively, which surround, but are spaced away from, the micropoints 18 as shown in FIG. 1.

The conductive grid structure 22 forms a low potential anode that is used to extract electrons from the micropoints 18. The conductive grid structure 22 has a grid construction comprising multiple row lines that are orthogonal to the column lines formed by the conductive structure 14. The row and column lines are part of the addressable matrix as described below.

The anode assembly 8 usually has a transparent (e.g., glass) substrate 24 and a transparent conductive layer 26 formed over the substrate 24 (on the side facing cathode assembly 6). A black matrix grill 25 is formed over the conductive layer 26 to define pixel regions 28, in which a cathodoluminescent coating is deposited.

The anode assembly 8 is typically manufactured using conventional photolithography processes to form successively defined features on the lower (as shown in FIG. 1) surface of the transparent substrate 24, starting with transparent conductive layer 26. The next features usually formed are the spacers 4, which project downwardly (e.g., about 150 microns) from conductive layer 26. The black matrix grill 25 is then formed defining the pixel regions 28, in which phosphor material is deposited.

When assembled, the anode assembly 8 is positioned a predetermined distance from the cathode assembly 6 (and from micropoints 18) by the spacers 4.

A power supply 30 is electrically coupled to the conductive layer 26 of the anode assembly 8 and to the conductive structure 14 (at the base of the micropoints 18) and the conductive grid structure 22 of the cathode assembly 6. A vacuum in the space between cathode assembly 6 and anode assembly 8 facilitates travel of electrons emitted from the micropoints 18 towards the pixel regions 28 to impact the pixel regions 28. The emitted electrons strike the cathodoluminescent coating in the pixel regions 28, which emits light to form a video image on a display screen formed by the anode assembly 8.

The visible display of the FED 10 is normally arranged as a matrix of pixels, one of which (single pixel 32) is shown in FIG. 1. Each pixel in the display is typically associated with a group of micropoint emitters, with all emitters in a group being dedicated to controlling the brightness of their associated pixel. For example, FIG. 1 shows a single pixel 32, with the pixel being associated with micropoints 18. For convenience of illustration, FIG. 1 shows a line of four emitters as being associated with the single pixel 32. Pixel 32 could be a single pixel of a black and white display or a single red, green, or blue dot associated with a single pixel of a color display.

The row lines of the conductive grid structure 22 and the column lines of the emitter conductive structure 14 form an addressing matrix for selectively activating pixels. Normally, the row and column lines are arranged so that the emitters associated with one pixel can be controlled independently of all other emitters in the display and so that all emitters associated with a single pixel are controlled in unison. In operation, a row signal activates a single conductive row line within the conductive grid structure 22, while a column signal activates a conductive column line within the emitter base conductive structure 14. At the intersection of an activated column and an activated row, a grid-to-emitter voltage differential sufficient to induce field emission will exist, causing illumination of a respective pixel.

Conventional photolithography processes are typically used to fabricate the various structures (e.g., the conductive structure 14) of the FED 10.

It has been found in prior art FEDs that the addressing conductive structure 14 sometimes electrically shorts to the conductive grid structure 22. Such electrical shorting degrades the quality of the display and can even make the FED 10 inoperative. The shorting is believed to result from manufacturing flaws in FEDs. For example, intrinsic defects in the dielectric structure 20 may effectively form conductive paths between the column addressing line and the grid. In addition, variations in the substrate and grid surfaces that cause the surfaces to be closer than intended may also cause shorting. A need, therefore, exists for an improved FED construction that significantly reduces the possibility of electrical shorting between column and row lines.

BRIEF SUMMARY OF THE INVENTION

The present invention is directed to an FED that has a cathode assembly containing an improved addressing column line structure. The addressing column line structure includes a conductive structure formed on a substrate. A resistive layer is formed over the conductive structure and an insulator layer is formed partly over the resistive layer. Electrical contact between the base of the emitter tips and the addressing column line is achieved through lateral sides of the conductive structure not covered by the insulator layer. The insulator layer helps reduce the possibility of electrical shorts between the column line and the row line structure of the cathode assembly. The insulator layer on top of the addressing column line will allow the use of a thinner subsequent dielectric layer. This thinner dielectric layer, which supports the grid, will provide a lower RC time constant and help achieve better video rate operation. The thinner dielectric layer also will result in smaller grid openings above the tips. This will provide for better beam spots and, therefore, better image resolution. The thinner dielectric layer will require less applied voltage to extract electrons from the emitter tips, resulting in lower power consumption for the FED.

These and other advantages of the present invention will become readily apparent from the following detailed description wherein embodiments of the invention are shown and described by way of illustration of the best mode of the invention. As will be realized, the invention is capable of other and different embodiments, and its several details may be capable of modifications in various respects, all without departing from the invention. Accordingly, the drawings and description are to be regarded as illustrative in nature and not in a restrictive or limiting sense with the scope of the application being indicated in the claims.

BRIEF DESCRIPTION OF THE DRAWINGS

For a fuller understanding of the nature and objects of the present invention, reference should be made to the following detailed description taken in connection with the accompanying drawings wherein.

DETAILED DESCRIPTION OF THE PREFERRED EMBODIMENTS

Figure 2:
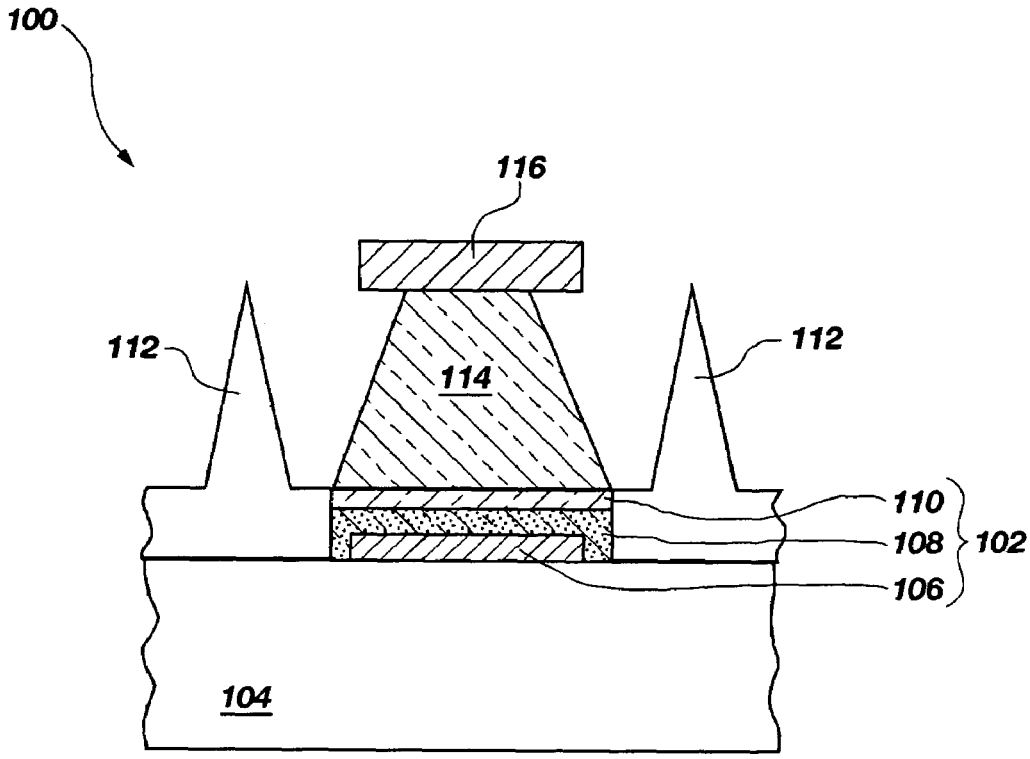
FIG. 2 is an enlarged cross-sectional view of a part of an FED in accordance with the invention, which illustrates a portion of an insulated addressing column line and also the lateral contact between the base of the emitter tips and the addressing column line.
Figure 3:
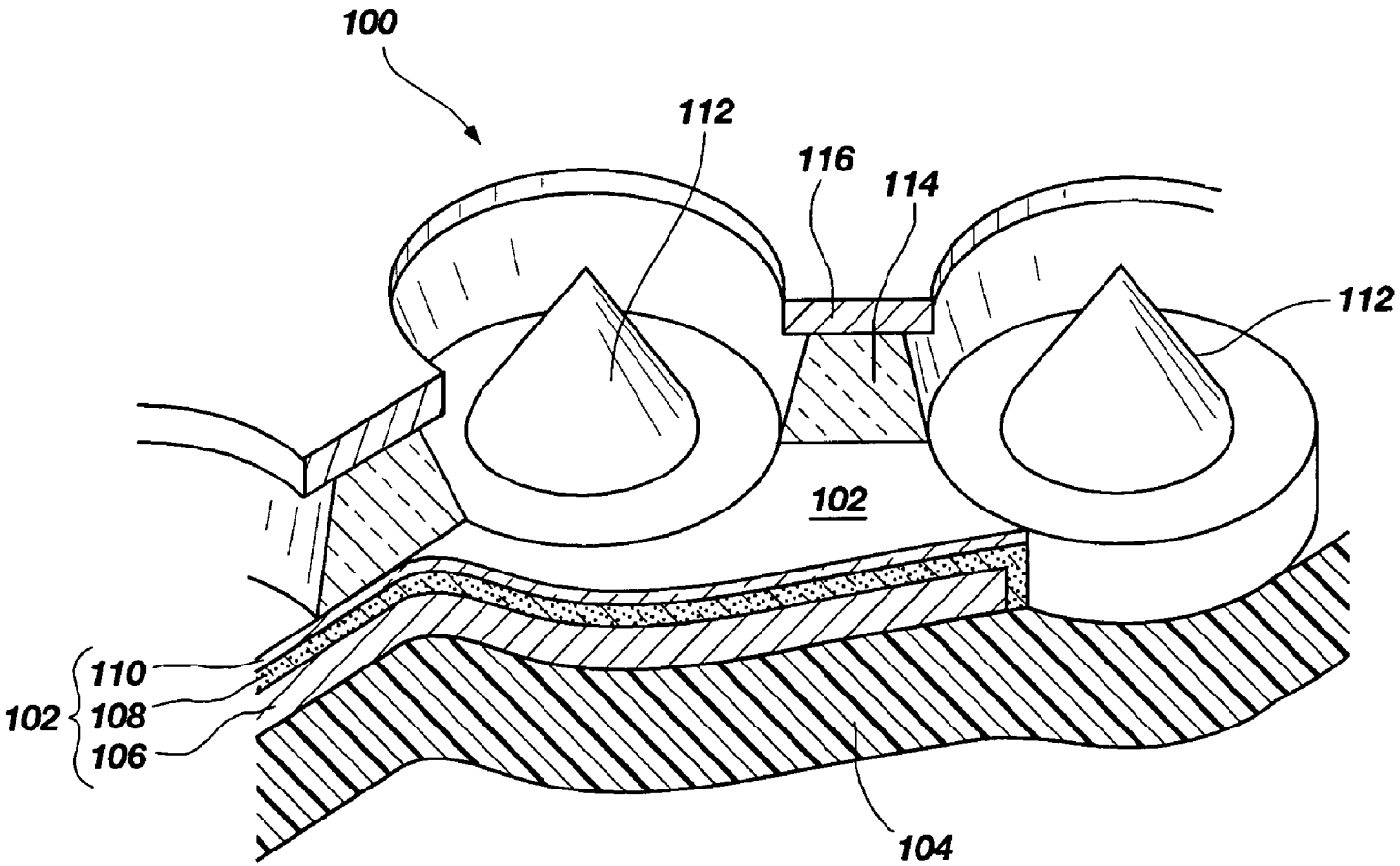
FIG. 3 is a perspective view of a portion of the FED partly broken away to illustrate the inventive addressing column line structure in greater detail.

The present invention is directed to an improved FED, in which column addressing lines are insulated to reduce the possibility of shorting and to provide other benefits. FIGS. 2 and 3 show a small portion of the cathode assembly of an FED 100 illustrating the inventive column addressing line structure 102.

The inventive column line structure 102 (a small portion of which is shown) is preferably formed on a substrate or base plate 104 of the cathode assembly. The column line structure 102 comprises a conductive layer 106, a resistive layer 108, and an insulator layer 110.

Figure 1:
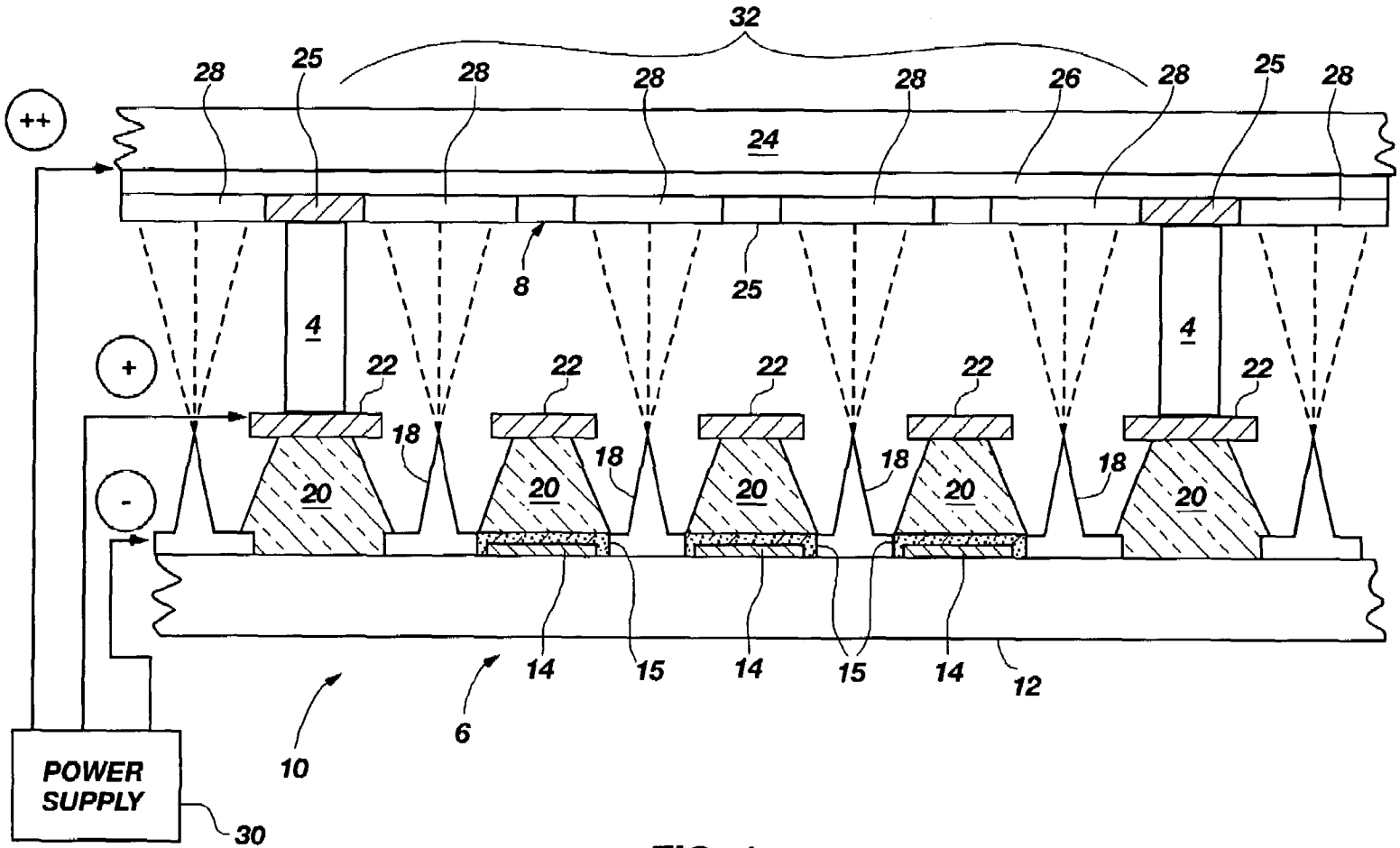
FIG. 1 (PRIOR ART)
FIG. 1 is a cross-sectional view of a portion of an exemplary prior art FED.

The conductive layer 106 is preferably formed like the conductive structure 14 of the FED 10 of FIG. 1. It may comprise a variety of conductive materials including metals. For example, the conductive layer 106 may comprise an aluminum layer having a thickness of about 1000 Å.

The resistive layer 108 is preferably similar to the resistive layer 15 in FIG. 1 in that it covers the top and sides (as shown in the drawings) of the conductive layer 106. The resistive layer 108 may comprise various materials including silicon. For instance, the resistive layer 108 may be boron doped silicon having a thickness also of about 1000 Å.

The insulator layer 110 has higher resistivity than the resistive layer 108. It is preferably formed to cover just the top of the resistive layer. If the insulator layer 110 also covered an entire side of the resistive layer 108, then the insulator layer 110 might interfere with electrical communication between the conductive layer 106 and the adjacent emitter 112. Therefore, as shown in FIGS. 2 and 3, insulator layer 110 preferably covers the top and not the sides of the resistive layer 108. However, in an alternative embodiment, the insulator layer 110 could also cover selected portions of the sides of the resistive layer 108.

The insulator layer 110 may be made of various insulative materials including, e.g., silicon dioxide or silicon nitride. The insulator layer 110 may have a thickness of about 1000 Å. The combination of resistive layer 108 and insulator layer 110 together preferably introduce a substantial amount of resistivity, preferably, in excess of 1 megaohm between conductive layer 106 and the grid 116.

The insulator layer 110 is to assist in reducing shorts between the addressing column line and the row lines on the grid 116. The dielectric layer 114 is used to support the grid 116 above the emitters 112. It is to be understood that the insulator layer 110 and the dielectric layer 114 may be made of the same or different material and still be within the scope of the present invention. Regardless of whether the same or different materials are used, as will be discussed below, the insulator layer 110 and the dielectric layer 114 are preferably separately formed. The insulator layer 110 reduces the possibility of shorting between the addressing column line structure and the row line structure, which as previously discussed may result from, e.g., intrinsic defects in the dielectric structure or unintended variations in spacing between the substrate and grid surfaces.

It should be recognized that a variety of alternative materials of different thicknesses may be used for the conductive layer 106, the resistive layer 108, and the insulator layer 110.

The improved addressing line structure 102 is preferably fabricated as follows. First, the conductive layer 106 is formed on the base plate 104 using conventional photolithography techniques. Specifically, a layer of material from which the conductive layer 106 is to be formed is first deposited on the base plate 104 using conventional deposition techniques. Then, using a conventional photolithography/etch/strip sequence, the conductive layer 106 is formed.

Thereafter, the resistive and insulator layers 108, 110 are formed. First, a layer of material from which the resistive layer 108 is formed is deposited over the conductive layer 106. Then, a layer of material from which the insulator layer 110 is formed is deposited over the layer of resistive material. Next, using a conventional photolithography/etch/strip sequence, the resistive layer 108 and insulator layer 110 are formed on the conductive layer 106.

To complete fabrication of the cathode assembly, the micropoint emitters 112, the dielectric layer 114, and the conductive grid 116 are then formed preferably using conventional photolithography techniques. The micropoint emitters 112 are preferably formed such that the addressing line structure 102 is disposed around (and in contact with) adjacent micropoint emitters 112 associated with a given pixel. The insulating layer deposited over the resistive layer 108, which covers the conductive layer 106, does not affect the electrical relationship between the conductive layer 106 and the adjacent emitters 112 because the sides of the addressing line structure 102 in contact with the emitters are not insulated.

The cathode assembly formed with the inventive column addressing line structure can be assembled with a conventional anode assembly like that shown in FIG. 1 to form an FED.

Adding the insulator layer 110 to the addressing lines requires one additional deposition step in FED fabrication, namely the step of depositing the insulator layer 110 on top of the resistive layer 108. However, no extra photolithography sequences are required for forming the insulator layer 110 because the insulator and resistive layers 110, 108 are etched from a single mask pattern. This is possible because when viewed from the top, in the preferred embodiment of the addressing line (as shown in FIG. 2), the outer edges of the insulator layer 110 and the underlying resistive layer 108 are substantially aligned, i.e., the insulator layer 110 substantially exactly overlies the resistive layer 108. Therefore, no extra photolithography (or masking) steps are needed, which are well known to be costly, complex and time consuming.

Many variations of the above-described preferred embodiments are possible. For example, one alternative embodiment might include more layers than the above-described combination of an insulator layer 110 and a resistive layer 108. For example, multiple resistive layers could be layered on top of one another to form a suitably high series resistance.

It has been found that by insulating column addressing lines in accordance with the invention, there is a significantly reduced possibility of shorting between column and row lines when the FED is in use.

The insulated column line structure also provides other advantages. For instance, addition of the insulator layer 110 increases the distance between the conductive layer 106 and the grid 116. This improves the FEDs' refresh rate by decreasing the associated RC constant. "R" is the resistance of the conductive lines (both grid and column) and "C" is the capacitance between a column line and the grid layer. C is proportional to A/d (where "A" is a cross-sectional area and "d" is the distance between the plates). By increasing d, C is reduced, which thereby reduces the RC constant. The reduced RC time constant will assist in achieving a better video rate operation of the display.

Other benefits of the invention include an ability to use thinner dielectric layers 114, which allows smaller cavity openings around the emitter tip to be constructed. This consequently reduces the beam spot and improves display images.

Having described embodiments of the present invention, it should be apparent that modifications can be made without departing from the scope of the present invention.

The invention claimed is:

1. A column line structure for use in a cathode assembly of a field emission device, comprising:

an elongated conductive structure;

a resistive layer disposed on a top surface of the elongated conductive structure and extending over at least a portion of one or more side surfaces thereof to form at least one resistive layer side surface;

an insulative layer disposed over a top surface of the resistive layer having an outer edge substantially aligned with at least one resistive layer side surface; and wherein the column line structure is positioned between a substrate and a dielectric layer.

2. The column line structure of claim 1, wherein the elongated conductive structure comprises metal.

3. The column line structure of claim 1, wherein the elongated conductive structure comprises aluminum.

4. The column line structure of claim 1, wherein the resistive layer comprises silicon.

5. The column line structure of claim 1, wherein the insulative layer comprises silicon oxide.

6. The column line structure of claim 1, wherein the insulative layer comprises silicon nitride.

7. The column line structure of claim 1, wherein the insulative layer has a thickness of about 1000 Å.

8. A field emission device, comprising a cathode assembly and an anode assembly assembled with the cathode assembly, wherein the cathode assembly includes an addressing matrix comprising multiple row lines elevationally disposed above column lines, the column lines having an insulating layer disposed thereon over a top surface thereof, wherein the insulating layer substantially exactly overlies the column lines and wherein the column lines and the insulating layer are positioned between a substrate and a dielectric layer.

9. The field emission device of claim 8, wherein the column lines include at least one conductive layer and a resistive layer disposed over at least a top surface of the at least one conductive layer.

10. The field emission device of claim 9, wherein the resistive layer extends over at least a portion of at least one side surface of the at least one conductive layer.

11. The field emission device of claim 10, wherein the resistive layer extends over opposing side surfaces of the at least one conductive layer.

12. The field emission device of claim 1, wherein the resistive layer is disposed directly on the top surface of the elongated conductive structure.

13. A field emission device, comprising:

a plurality of column line structures, each of the plurality of column line structures comprising:

an elongated conductive structure;

a resistive layer disposed on a top surface of the elongated conductive structure and extending over at least a portion of one or more side surfaces thereof; and an insulative layer disposed over a top surface of the resistive layer and having outer edges substantially aligned with side surfaces of the resistive layer; and a dielectric layer disposed over at least portions of the plurality of column line structures, wherein the dielectric layer is disposed over a top surface of the insulative layer of the plurality of column line structures.

14. The field emission device of claim 13, wherein the elongated conductive structure comprises metal.

15. The field emission device of claim 13, wherein the elongated conductive structure comprises aluminum.

16. The field emission device of claim 13, wherein the resistive layer comprises silicon.

17. The field emission device of claim 13, wherein the insulative layer comprises silicon oxide.

18. The field emission device of claim 13, wherein the insulative layer comprises silicon nitride.

19. The field emission device of claim 13, wherein the insulative layer has a thickness of about 1000 Å.

20. The field emission device of claim 13, wherein the resistive layer is disposed directly on the top surface of the elongated conductive structure.

* * * * *